US006508532B1

(12) United States Patent
Hawkins et al.

(10) Patent No.: US 6,508,532 B1
(45) Date of Patent: Jan. 21, 2003

(54) ACTIVE COMPENSATION FOR CHANGES IN THE DIRECTION OF DROP EJECTION IN AN INKJET PRINTHEAD HAVING ORIFICE RESTRICTING MEMBER

(75) Inventors: Gilbert A. Hawkins, Mendon, NY (US); David L. Jeanmaire, Brockport, NY (US)

(73) Assignee: Eastman Kodak Company, Rochester, NY (US)

( * ) Notice: Subject to any disclaimer, the term of this patent is extended or adjusted under 35 U.S.C. 154(b) by 110 days.

(21) Appl. No.: 09/696,680

(22) Filed: Oct. 25, 2000

(51) Int. Cl.[7] ..... B41J 2/015; B41J 2/07
(52) U.S. Cl. ..... 347/20; 347/82
(58) Field of Search ..... 347/20, 82, 77, 347/74–75, 73, 54, 47, 40, 48, 38; 251/11; 137/517; 216/27; 29/890.1

(56) References Cited

U.S. PATENT DOCUMENTS

| | | | | | |
|---|---|---|---|---|---|
| 3,877,036 | A | | 4/1975 | Loeffler et al. | 347/77 |
| 4,238,804 | A | | 12/1980 | Warren | 347/81 |
| 4,364,057 | A | | 12/1982 | Ebi et al. | 347/81 |
| 4,770,740 | A | * | 9/1988 | Tsuzuki et al. | 137/517 |
| 5,185,615 | A | | 2/1993 | Koitabashi et al. | 347/37 |
| 5,250,962 | A | | 10/1993 | Fisher et al. | 347/32 |
| 5,517,223 | A | * | 5/1996 | Shin | 347/38 |
| 5,592,202 | A | | 1/1997 | Erickson | 347/32 |
| 5,880,752 | A | * | 3/1999 | Weber et al. | 251/11 |
| 5,900,892 | A | * | 5/1999 | Mantell et al. | 29/890.1 |
| 6,012,805 | A | * | 1/2000 | Hawkins et al. | 347/82 |
| 6,079,821 | A | | 6/2000 | Chwalek et al. | 347/82 |
| 6,171,875 | B1 | * | 1/2001 | Silverbrook | 216/27 |
| 6,227,658 | B1 | * | 5/2001 | Matsuda et al. | 347/40 |
| 6,302,526 | B1 | * | 10/2001 | Lin et al. | 347/48 |
| 6,364,470 | B1 | * | 4/2002 | Cabal et al. | 347/82 |

* cited by examiner

*Primary Examiner*—Lamson Nguyen
*Assistant Examiner*—K. Feggins
(74) *Attorney, Agent, or Firm*—Norman Rushefsky

(57) ABSTRACT

For an inkjet printhead (10) having at least one nozzle (24) and a nozzle opening (26) in the nozzle (24), a disk (28) having an off-center aperture (38) about the disk axis (X, Y) positioned over the nozzle opening (26), a system and method of compensating for the effects of defects in the inkjet printhead (10) to alter the direction of ink drops (37) ejected from the nozzle (24). Initially, the printhead (10) is tested to determine the amount of compensation desired in the direction of ink (34) ejected from the nozzle opening (26). The method comprises the step of applying heat to at least one finger-like actuator (42), causing the thermal actuator (42) to deform semi-permanently. The method further comprises the step of sliding the disk (28) over the nozzle (24) so that the off-center aperture (38) traverses the nozzle opening (26) and causes the ink (34) ejected from the nozzle opening (26) to be deflected with regard to the desired amount of compensation. Once the disk (28) has been adjusted accordingly, the application of heat is ceased, causing the thermal actuator (42) to hold the disk (28) in the desired position.

44 Claims, 8 Drawing Sheets

ACTIVE COMPENSATION FOR CHANGES IN THE DIRECTION OF DROP EJECTION IN AN INKJET PRINTHEAD HAVING ORIFICE RESTRICTING MEMBER

CROSS-REFERENCE TO RELATED APPLICATION

The application is commonly assigned and related to:

1. U.S. patent application Ser. No. 09/696,536, filed Oct. 25, 2000 and entitled "Active Compensation For Changes in the Direction of Drop Ejection in an Inkjet Printhead," by Gilbert A. Hawkins et al. and
2. U.S. patent application Ser. No. 09/696,541, filed Oct. 25, 2000, and now U.S. Pat. No. 6,390,610, issued May 21, 2002, and entitled "Active Compensation for Misdirection of Drops in an Inkjet Printhead Using Electrodeposition," by Gilbert A. Hawkins et al.

FIELD OF THE INVENTION

This invention relates in general to inkjet printheads and, more specifically, to control in the directionality of ink drops ejected from a printhead in order to improve image quality. More particularly, the invention relates to techniques for compensating for the defects in an inkjet printhead using a disk-type structure to alter the direction of ink drops ejected from the nozzle.

BACKGROUND OF THE INVENTION

Without limiting the scope of the invention, its background is described in connection with inkjet printers, as an example.

Modern color printing relies heavily on inkjet printing techniques. The term "inkjet" as utilized herein is intended to include all drop-on-demand or continuous inkjet printer systems including, but not limited to, thermal inkjet, piezoelectric, and continuous, which are well known in the printing industry. Essentially, an inkjet printer produces images on a receiver medium, such as paper, by ejecting ink droplets onto the receiver medium in an image-wise fashion. The advantages of non-impact, low-noise, low-energy use, and low cost operation, in addition to the capability of the printer to print on plain paper, are largely responsible for the wide acceptance of inkjet printers in the marketplace.

The printhead is the device that is most commonly used to direct the ink droplets onto the receiver medium. A printhead typically includes an ink reservoir and channels, which carry the ink from the reservoir to one or more nozzles. Typically, sophisticated printhead systems utilize multiple nozzles for applications such as high-speed continuous inkjet printer systems, as an example. Continuous inkjet printhead device types include electrostatically controlled printheads and thermally steered printheads. Both printhead types are named according to the means used to steer ink droplets ejected from nozzle openings.

It is well known in the art of inkjet printing that image quality suffers from a failure to accurately control the direction from which ink drops exit the printhead. Variations in the direction of ink drops ejected from a given nozzle from a desired direction of ejection (usually perpendicular to the printhead surface) can occur due to changes in the nozzle during operation, as a result of manufacturing defects present before operation, or both. In most instances, repairs are too difficult and costly, resulting in scrapped parts and decreased manufacturing yields. Accordingly, a cost effective way of increasing printhead lifetimes and printhead production yields would be advantageous.

For any given nozzle, the direction of the exiting ink drop stream is controlled by the physical characteristics of the nozzle. Where misdirection occurs, the ink drops can produce printing artifacts such as random placement errors between subsequent drops from a single nozzle or placement errors of drops from one nozzle with respect to those from another nozzle. Variations in the direction of ink drops ejected from a given nozzle may occur over a variety of time scales. For example, in Bubble Jet printheads, made by Canon Company, rapid variations may occur when bubbles nucleate randomly on the surfaces of heaters, causing random variations in the velocity and direction of ejected ink drops from each nozzle. Variations in the direction of ejected ink drops may also be caused by sources external to the inkjet printhead such as, for example, vibrations of the inkjet printer. It is difficult or impossible to correct such random variations in the direction of ejected ink drops, which typically change rapidly with time.

In other cases, factors causing deviation of the direction of ejected ink drops from a desired direction can occur slowly over a long period of time. Such slowly changing variations may arise, for example, from gradual changes in the material properties of the nozzle, such as changes in the stress of the materials comprising the nozzle or surrounding the nozzle openings, from changes in the resistance of heater materials during operation, or from wear of nozzle materials during operation.

In still other cases, factors causing deviation of the direction of ejected ink drops from a desired direction can be essentially permanent. Deviations caused by manufacturing defects in nozzles, for example defects that alter or vary the shape of the nozzle openings, are essentially permanent. Permanent deviations may also arise after a period of time of operation of a nozzle. For example, a piece of material may become permanently chipped away from a portion of a nozzle after a period of time of operation, or a piece of material may lodge permanently within a nozzle during operation.

Thus, it is desirable to compensate for slowly changing variations in the directionality of ejected ink drops. For slowly changing variations, compensation may be needed from time to time during operation. It is also desirable to compensate for permanent changes in the directionality of ejected ink drops in order to improve image quality and increase manufacturing yield. Compensation cannot be applied before operation of the nozzles, since it is generally not possible to predict the direction and magnitude of deviations in the direction of ejected drops for a particular nozzle, which occur after operation. Compensation applied after or during operation of nozzles is herein referred to as active compensation.

Substantial effort has been directed toward active compensation for slowly changing variations in the direction of drop ejection for drop-on-demand printers, as discussed and illustrated, for example, in U.S. Pat. No. 4,238,804, assigned to Xerox Corporation, and U.S. Pat. No. 3,877,036, assigned to IBM, which teach measuring the position of ejected ink drops and compensating for variations from the ideal direction by electrostatic means. While such electrostatic deflection can be used to direct ink in a desired direction, as is well known in the art, electrostatic deflection in these cases adds mechanical complexity. Also, correction techniques of this type are largely ineffective in cases where large variations in the direction of ejected ink drops occur.

U.S. Pat. No. 5,592,202, assigned to Laser Master Corporation, teaches an electronic means to correct inaccuracies in ink drop placement by advancing or retarding the time of a drop-on-demand actuation pulse. However, this method does not correct variations in both of the directions of ink drop ejection in a plane perpendicular to the direction of drop ejection, as it is more suited to adjusting ink drop placement only in the scan direction of the printhead. Moreover, not all printhead circuits can be easily adapted to control the firing times of individual ink drops, since the firing pulses may be derived from a common clock.

U.S. Pat. No. 5,250,962, assigned to Xerox Corporation, teaches the application of a moveable vacuum priming station that can access groups of nozzles to remove entrained air in one or more nozzles. Although entrained air is known in the art to cause variations in the direction of ink drop ejection, it is only one of many mechanisms causing variations. Also, entrained air principally refers to failure of the ink to fill the printhead, not to a change in the head itself. Removal of trapped air serves to restore the nozzle to its original condition, but does not alter the physical characteristics of the nozzle.

Other prior art techniques for achieving compensation include the selection of one nozzle among a plurality of redundant nozzles for printing a particular imaging pixel, the preferred nozzle having favorable ink drop ejection characteristics. However, redundancy selection techniques of this type are complex in nature and require substantial real estate space on the printhead form factor to implement. Such methods also increase cost and/or reduce productivity.

In the case of continuous inkjet printheads using electrostatic steering of ink drops, as in the current generation of commercialized continuous inkjet printheads, for example those manufactured by Scitex Corporation, compensation for variations in the direction of ejected ink drops from an ideal direction can be accomplished by electrostatic means; and in this case, additional mechanical complexity is not required, since the means of printing itself is based on electrostatic deflection and the required hardware is already in place. Printheads of this type produce electrically charged ink drops, which are deflected using a charged electrode at each nozzle. The electrode voltage is set to one of two discreet values (for example, either 100 volts or 0 volts) each time an ink drop is ejected, causing ink drops to be deflected either in a printing direction (for example, in the case the voltage is 100 volts), or into a gutter (for example, in the case the voltage is 0). To correct for slow or permanent deviations of the direction of ejected drops from a particular nozzle, the voltage corresponding to printing at that nozzle might be set, for example, to 110 volts. The use of electrostatic techniques such as these, however, requires additional voltage control hardware.

In the case of continuous inkjet printheads using thermal steering of ink drops, an electrode apparatus is not already in place, and other means of correction are desired to correct for the effects of slow variations in direction of ink drop ejection, as well as for permanent manufacturing defects.

Accordingly, a need exists for a cost effective method of correcting defects in inkjet printheads to permit compensation in the direction of ink drops ejected from the nozzles. A means of increasing manufacturing yields by permitting active compensation for ink drop ejection misdirection from a nozzle would provide numerous advantages.

SUMMARY OF THE INVENTION

The present invention provides a method of compensating for the effects of manufacturing defects in an inkjet printhead having at least one nozzle and nozzle opening in the nozzle, and a disk having an off-center aperture about the disk axis positioned over the nozzle opening to direct ink drops ejected from the nozzle. With the present invention, printheads that would normally be discarded due to defects that cause ink drop misdirection can be repaired rather than discarded.

Accordingly, disclosed in one embodiment is a method of compensating for the effects of defects in an inkjet printhead to permit control in the direction of ink drops ejected from a nozzle of the printhead. Initially, the printhead is tested to determine the ink stream directionality onto a receiver medium, such as paper, from a nozzle opening. Variability in the direction of the ink drops ejected from a nozzle of the inkjet printhead caused by manufacturing defects is then identified. Thus, the amount of misdirection from a nozzle of an inkjet printhead can be quantified and the amount of compensation desired in the direction of ink ejected from the nozzle opening can be determined.

The method comprises the step of sliding the disk over the nozzle so that the off-center aperture traverses the nozzle opening and causes ink ejected from the nozzle opening to be deflected with regard to the desired amount of compensation. In one embodiment, heat is applied to at least one finger-like actuator, for example a thermal actuator. Such heat causes the finger-like actuator to traverse in an up and down direction about the disk. Thus, the disk aperture is adjusted about the nozzle opening in order to correct the misdirection of ink ejected from the nozzle opening.

Once the desired amount of compensation has been achieved by adjusting the disk, the application of heat to the finger-like actuator is then ceased. The elimination of heat causes the finger-like actuator to return to its non-actuated state, which serves to hold the disk forcibly in the desired position.

In accordance with yet another embodiment, an internal heater is activated, causing the adhesive, or wax, to melt and the disk to be released. An external force is then applied in order to accomplish the step of sliding the disk over the nozzle so that the off-center aperture traverses the nozzle opening and causes ink ejected from the nozzle opening to be deflected with regard to the desired amount of compensation. Once the disk is adjusted to its desired position, the internal heater is deactivated in order to allow the adhesive to cool. This allows the disk to remain forcibly in its desired position.

According to another embodiment, the step of activating the internal heater is then followed by the step of activating at least one external heater, which is adapted to expand a mass of thermally expandable material. Thus, the mass of thermally expandable material is utilized in sliding the disk in a position for compensating for the effects of defects in an inkjet printhead. Upon causing the ink ejected from the nozzle opening to be deflected with regard to the desired amount of compensation via sliding the disk, the internal heater is then deactivated in order to allow the adhesive to cool. The external heater is then deactivated in order to cease expansion of the thermally expandable material. As such, the disk remains in its desired position in order to correct misdirection of ink drops ejected from the nozzle opening.

In accordance with yet another embodiment, disclosed is an inkjet printhead with integral compensation for misdirection of ink drops ejected through at least one nozzle of the printhead. The inkjet printhead comprises a substrate forming a wall, which defines a nozzle cavity adapted for facilitating the flow of ink from an ink reservoir. The inkjet printhead also comprises a membrane predisposed about the nozzle cavity to create a resistive barrier against ink flow. The membrane includes a nozzle opening to which ink drops are ejected.

The inkjet printhead further comprises a disk positioned over the nozzle opening. The membrane further comprises a recess, which is symmetrical with the nozzle opening. Thus, the recess is configured to accept the disk.

The disk, which comprises a solid material, has an off-center aperture about its axis. The off-center aperture of the disk is the same size as that of the nozzle opening. As such, the disk is configured to rotate in any direction within the recess and is adapted to cause ink ejected from the nozzle opening via the off-center aperture about the disk axis to be deflected with regard to a desired amount of compensation.

The inkjet printhead further comprises one or more finger-like actuators configured to retain and release the disk. The finger-like actuators, which are shaped memory alloy type, are adapted to deform semi-permanently when heated over a first temperature range, returning to their original shape when heated to a second, higher, temperature range. The actuators can have different shapes, such as rectangular or square shape, and can be of the bi-metallic type.

The inkjet printhead also comprises a means for determining the amount of compensation desired in the direction of ink ejected from the nozzle opening, as well as a means for sliding the disk over the nozzle so that the off-center aperture traverses the nozzle opening. In yet another embodiment, the inkjet printhead further comprises an adhesive adapted to secure the disk to the membrane within its recess. The adhesive, when melted, is adapted to release the disk and allow for a force to be effectively applied.

The inkjet printhead also comprises one or more internal heaters integrated within the membrane. The internal heaters are configured to activate via passage of an electrical current, thus, transitioning the adhesive into a molten state.

The inkjet printhead further comprises a force applied to the disk in order to adjust its position. That is, the adhesive, when melted, is adapted to release the disk and allow for a force to be effectively applied. Thus, the force can include an external force or an adjustment force. In yet another embodiment, the inkjet printhead further comprises a right adjustment heater and a left adjustment heater. The adjustment heaters are predisposed about the nozzle opening. In this case, an adjustment force is generated by one or more thermally expandable beads, which comprise a plastic material. Thus, the beads are adapted to expand and contract when heated by the adjustment heaters.

Technical advantages of the present invention include a cost effective method of compensating for the effects of defects in inkjet printheads that would otherwise result in misdirection of ink drops ejected from the nozzles. As such, printing artifacts caused by irregularities in the ink drops landing onto a receiver medium are eliminated.

Other technical advantages include the increase in manufacturing yields as printheads that would be typically discarded can be repaired and used.

BRIEF DESCRIPTION OF THE DRAWINGS

For a more complete understanding of the present invention, including its features and advantages, reference is made to the following detailed description of the invention, taken in conjunction with the accompanying drawings in which.

Corresponding numerals and symbols in these figures refer to corresponding parts in the detailed description unless otherwise indicated.

DETAILED DESCRIPTION OF THE INVENTION

While the making and using of various embodiments of the present invention are discussed in detail below, it should be appreciated that the present invention provides many applicable inventive concepts, which can be embodied in a wide variety of specific contexts. These specific embodiments discussed herein are merely illustrative of specific ways to make and use the invention, and do not delimit the scope or application of the invention.

Figure 1:
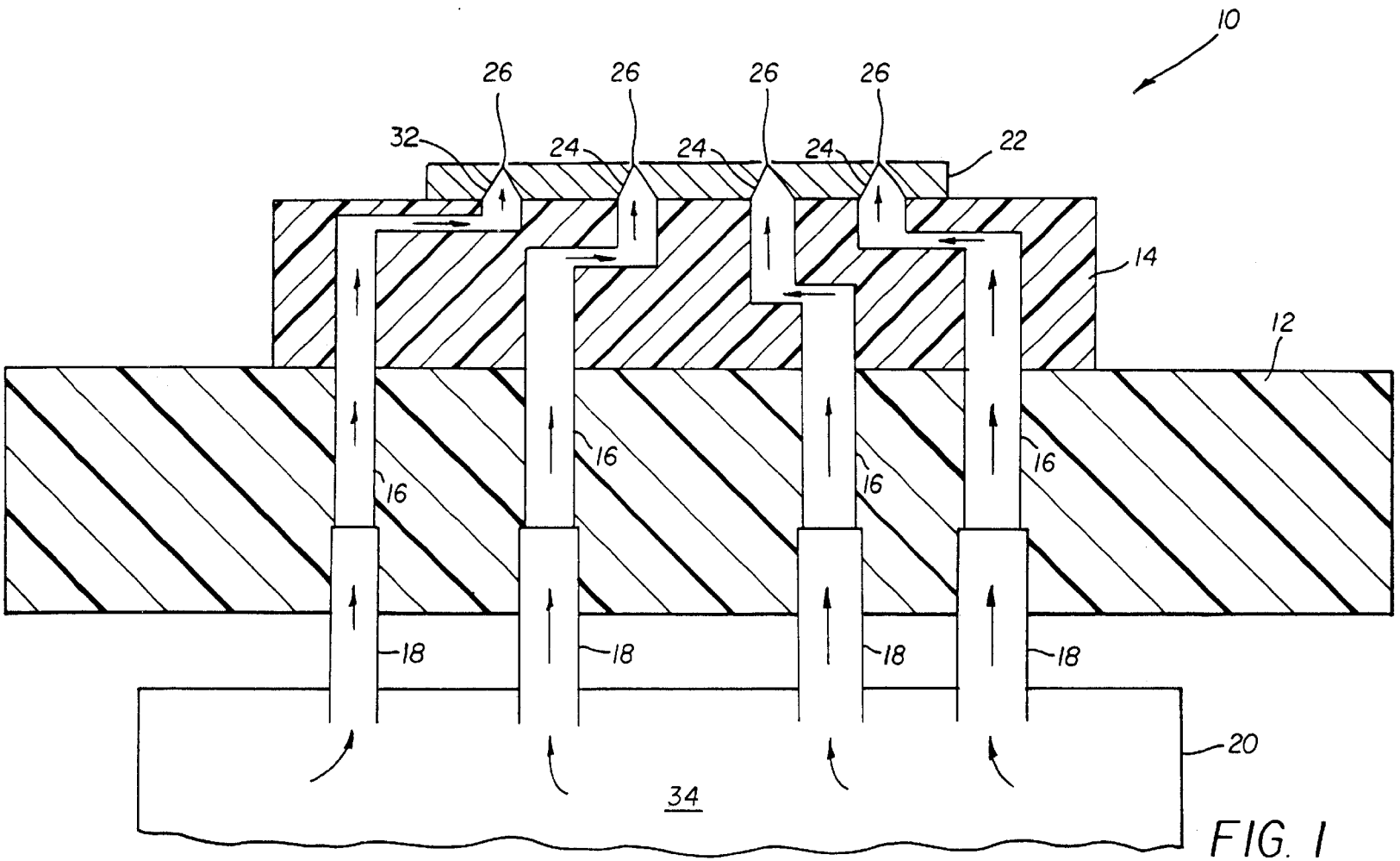
FIG. 1 is a diagram illustrating an inkjet printhead in which a preferred embodiment of the present invention may be implemented.

Referring to FIG. 1, therein is shown an inkjet printhead, denoted generally as 10, to which the active compensation techniques of the present invention can be applied. Inkjet printhead 10 is a device that is most commonly used to direct ink droplets or "drops" onto a receiver medium, such as paper. In some cases, such as continuous inkjet printing, the ink exits rapidly enough so as to form an ink drop stream which may subsequently break up into droplets. In other cases, such as in drop-on-demand printing, ink exits as discreet droplets as is well known in the art of inkjet printing. As such, the terms "ink drops", "ink droplets", and "ink stream" will be used interchangeably throughout.

Inkjet printhead 10 includes an ink reservoir 20, fluid-flow channels 18 and inlet/outlet tubes 16 which carry the ink 34 from the reservoir 20 to one or more nozzle cavities 32 and nozzles 24, which are at the top of the nozzle cavities 32. Inkjet printhead 10 also comprises a mounting block 12, a gasket manifold 14, and a substrate 22. Substrate 22 is attached to the gasket manifold 14, which, in turn, is bonded to the mounting block 12 in order to form the sub-assembly of inkjet printhead 10. The mounting block 12 and the gasket manifold 14 form a delivery system via fluid flow channels 18 which are defined within. The fluid flow channels 18 provide a route for the ink 34 to exit the nozzles 24 through their respective nozzle openings 26. Each of the nozzle openings 26 may also be referred to as an "orifice" and these terms will be interchangeable used throughout. Those skilled in the art will appreciate that the figures referred to herein are not drawn to scale and have been enlarged in order to illustrate the major aspects of the inkjet printhead 10. A scaled drawing would not show the fine detail necessary to portray and understand the present invention. In particular, nozzles 24 and nozzle openings 26 are formed in a membrane 30 (not shown in FIG. 1), which is at the top of substrate 22.

Figure 2A:
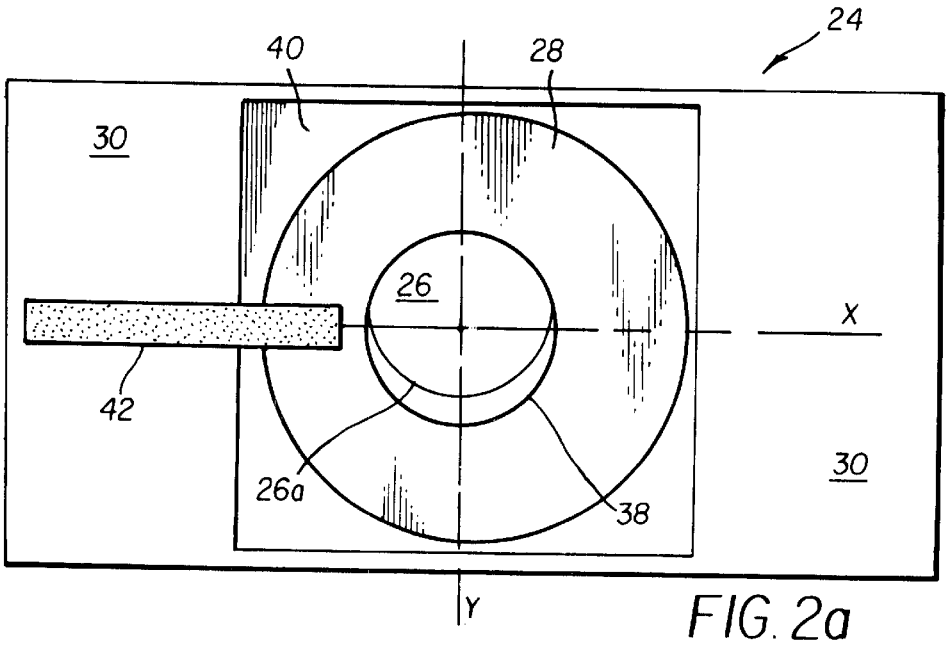
FIG. 2*a* shows a close-up view of a nozzle and nozzle opening of an inkjet printhead and a disk positioned over the nozzle opening, in accordance with a preferred embodiment of the present invention.
Figure 2B:
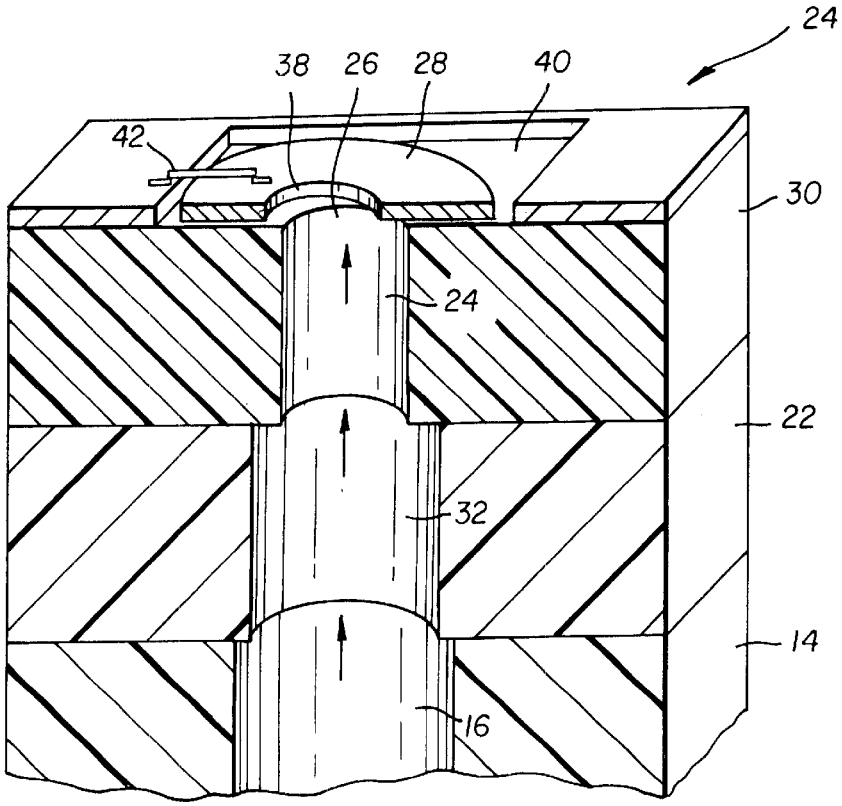
FIG. 2*b* is a cross-section of the nozzle and disk of FIG. 2*a,* in accordance with a preferred embodiment of the present invention.
Figure 2C:
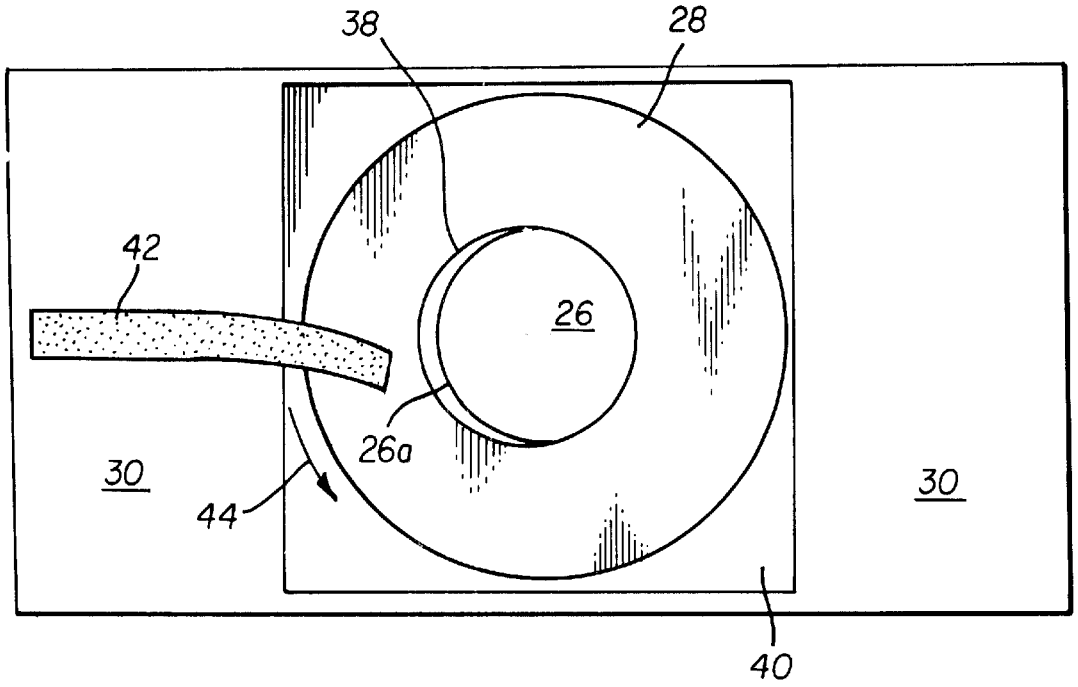
FIG. 2*c* illustrates the step of sliding the disk over the nozzle in order to compensate for the misdirection of ink drop ejection, in accordance with a preferred embodiment of the present invention.
Figure 2D:
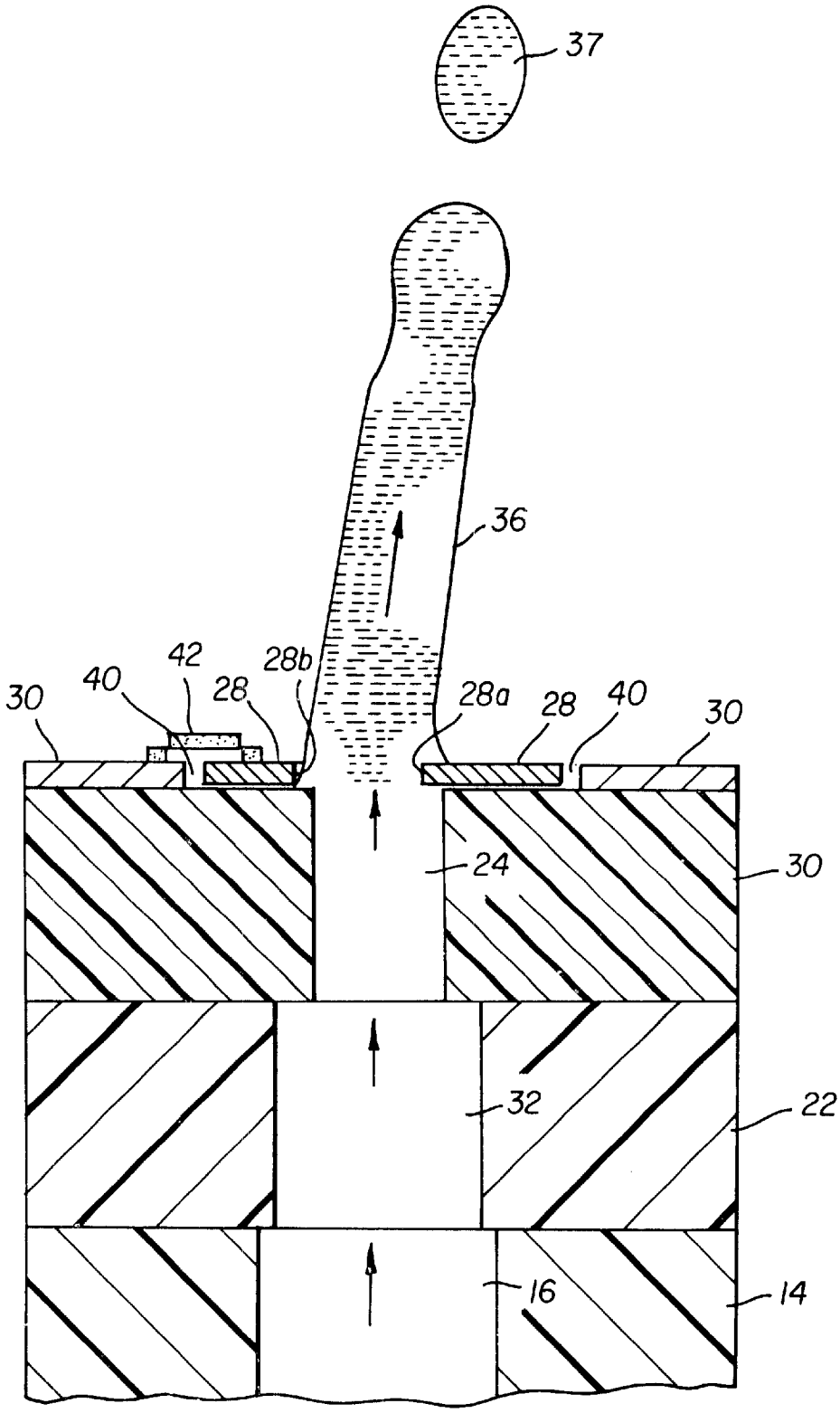
FIG. 2*d* shows the ejection of an ink stream for the case of a corrected nozzle, in accordance with a preferred embodiment of the present invention.

FIGS. 2*a*–2*d* illustrate various views in accordance with a preferred embodiment of the present invention. FIG. 2*a* shows a close-up top view of a nozzle 24 and a nozzle opening 26 of an inkjet printhead, such as printhead 10, and a disk 28 positioned over the nozzle opening 26. FIG. 2*b* is a cross-section of the nozzle 24 and disk 28 of FIG. 2*a*. As shown, substrate 22 forms a wall, which defines the nozzle cavity 32. As shown in FIG. 2*b*, the walls of nozzle cavity 32 are vertically oriented, although this need not be the case. For example, as shown in FIG. 2*b*, the walls of nozzle cavity 32 can be sloped. Nozzle cavity 32 is adapted for facilitating the flow of ink 34 from an ink reservoir 20. A membrane 30 is predisposed over the nozzle cavity 32 to create a resistive barrier against ink flow. Furthermore, membrane 30 includes a nozzle 24 having a nozzle opening 26, through which ink 34 is ejected. In operation, ink 34 from the nozzle cavity 32 is ejected though the nozzle 24 and out nozzle opening 26 and travels in an ink stream 36 as shown in FIG. 2*d*. Ink stream 36 subsequently breaks up into ink drops 37 (e.g., continuous inkjet printing) shown in FIG. 2*d*, or the ink 34 ejected out nozzle opening 26 may be in the form of discreet ink drops 37 (e.g. drop-on-demand inkjet printing). The protruding disk edge 28*a* and receding disk edge 28*b* serve to guide the ink stream 36 in the compensated direction.

At a distance removed from the printhead 10, the ink stream 36 breaks up into ink drops 37 travelling in the same direction as the ink stream 36. In continuous inkjet applications, inkjet printhead 10 causes the ink stream 36 and the ink drops 37 to be directed in a printing direction or in a non-printing direction. Typically, ink is recycled from the non-printing direction using a gutter assembly (not shown) that directs the ink 34 to a recycling unit (not shown). Thus, ink 34 travels from the ink reservoir 20 through the fluid flow channels 18 to the inlet/outlet tubes 16 in order to exit the nozzle opening 26, as shown in FIG. 2*b*.

For printheads having many nozzles, each similar to the nozzle 24 shown in FIGS. 2*a* (top view) and 2*b* (cross-section of FIG. 2*a*), a percentage of the nozzles (typically 1–5%) eject ink 34 in a direction that creates undesirable printing artifacts. The desired direction comprises an ink stream 36 exiting the nozzle opening 26 perpendicular to the top surface of the inkjet printhead 10. The desired direction is usually normal to the substrate 22 on which the inkjet printhead 10 is built.

A recess region 40, which is symmetrical with the nozzle opening 26, is located in membrane 30. The recess region 40 is configured to accept a disk, such as disk 28. Here, disk 28 of a solid material having an off-center aperture 38 about its axis (X, Y) is positioned over the nozzle opening 26 of nozzle 24. The disk's off-center aperture 38 is preferably the size of the nozzle opening 26. Thereby, disk 28 is adapted to cause ink ejected from the nozzle opening 26 to be deflected at an angle compared to a case in which the disk 28 is absent. As shown in FIG. 2*d*, that angle is determined by the direction by which the off-center aperture 38 is offset from nozzle opening 26, the deflection angle with respect to the vertical being in the direction where off-center aperture 38 encroaches the most over nozzle opening 26. The ability to deflect ink stream 36 at an angle, which is determined by the position of an off-center aperture 38, is found in accordance with the present invention to be useful in correcting the direction of propagation of ink streams and ink drops that are misdirected, for example, due to manufacturing defects.

In FIGS. 2*a* and 2*b*, a manufacturing defect is present in the configuration of nozzle 24, resulting in ink stream 36 being misdirected as it exits nozzle 24. Therefore, it is desired, in accordance with the present invention, to provide a means for compensating for such misdirection. To this end, device and hardware means are provided for adjusting the direction of ink stream 36 ejected from nozzle openings 26. That is, ink stream 36 can be adjusted, not just in one direction, but also arbitrarily in any direction.

A finger-like actuator 42, for example a thermal actuator, is positioned so as to rotate the disk 28 when actuated, as illustrated in FIG. 2*c*. The actuator shown in FIG. 2*c* is finger-like; however, other actuators may have different shapes, such as rectangular or square shapes, as might be the case for actuators made of piezo material, as would be appreciated by those skilled in the art of mechanical actuation. Disk 28 is coupled to membrane 30 and is configured to rotate in any direction within the recess region 40 of membrane 30. As is well known in the art of Micro Electromechanical technology, the thermal actuator 42 can be of the bi-metallic type or the shape memory alloy type, which deforms semi-permanently when heated over a first temperature range. The thermal actuator 42 is then adapted to return to its original shape when heated to a second, higher, temperature range. The thermal actuator 42, when not in the actuated state, can serve to hold the disk 28 forcibly down into the recessed region 40 of the membrane 30. For example, a bimetallic actuator 42 may be designed to gradually lift up, as well as to move laterally in the plane of the disk 28, to rotate the disk 28 when heated. If the thermal time constant for upward movement is designed to be larger than that for lateral movement, then disk 28 will be rotated each time the bi-metallic actuator 42 is heated, as can be appreciated by one skilled in the art of mechanical engineering.

Initially, each inkjet printhead 10 is tested to determine if it needs compensation. That is, the ink stream directionality is determined, for example, by observing the location of ink drops 37 ejected onto a receiver medium from a nozzle opening 26. This allows the amount of misdirection of the ink drops 37 ejected from a nozzle 24 of the inkjet printhead 10 caused by manufacturing defects to be identified. Furthermore, variability in the direction of the ink drops 37 ejected from the nozzle 24 assists in determining how much correction to apply in order to avoid discarding the printhead 10.

Here, the error in manufacturing is one that introduces a misdirected ink steam 36 ejected from nozzle 24 of inkjet printhead 10. Therefore, according to the preferred embodiment of the present invention, disk 28 includes a disk aperture 38 which is off-centered with respect to the disk axis (X, Y). The off-centered disk aperture 38 has been found useful in achieving compensation for the effects of a defect which results in misdirected ink stream 36 exiting the nozzle 24. In one embodiment, heat is applied to a finger-like actuator 42 causing the thermal actuator 42 to traverse in an up and down direction about the disk 28, as illustrated in FIG. 2*c*. Once disk 28 has been adjusted so as to compensate for the effects of defects in the printhead 10 in order to alter the direction of ink drops 37 ejected from nozzle 24, the application of heat is ceased causing the finger-like actuator 42 to hold disk 28 in the desired position. As shown in the cross-section of FIG. 2*d,* the fact that the disk aperture 38 is off-center with respect to nozzle opening 26 causes the ejected ink stream 36 to be deflected in a direction on line with the point of maximum distance between the edge of the disk aperture 38, the nozzle opening edge 26a, and the center of the nozzle opening 26.

Figure 2E:
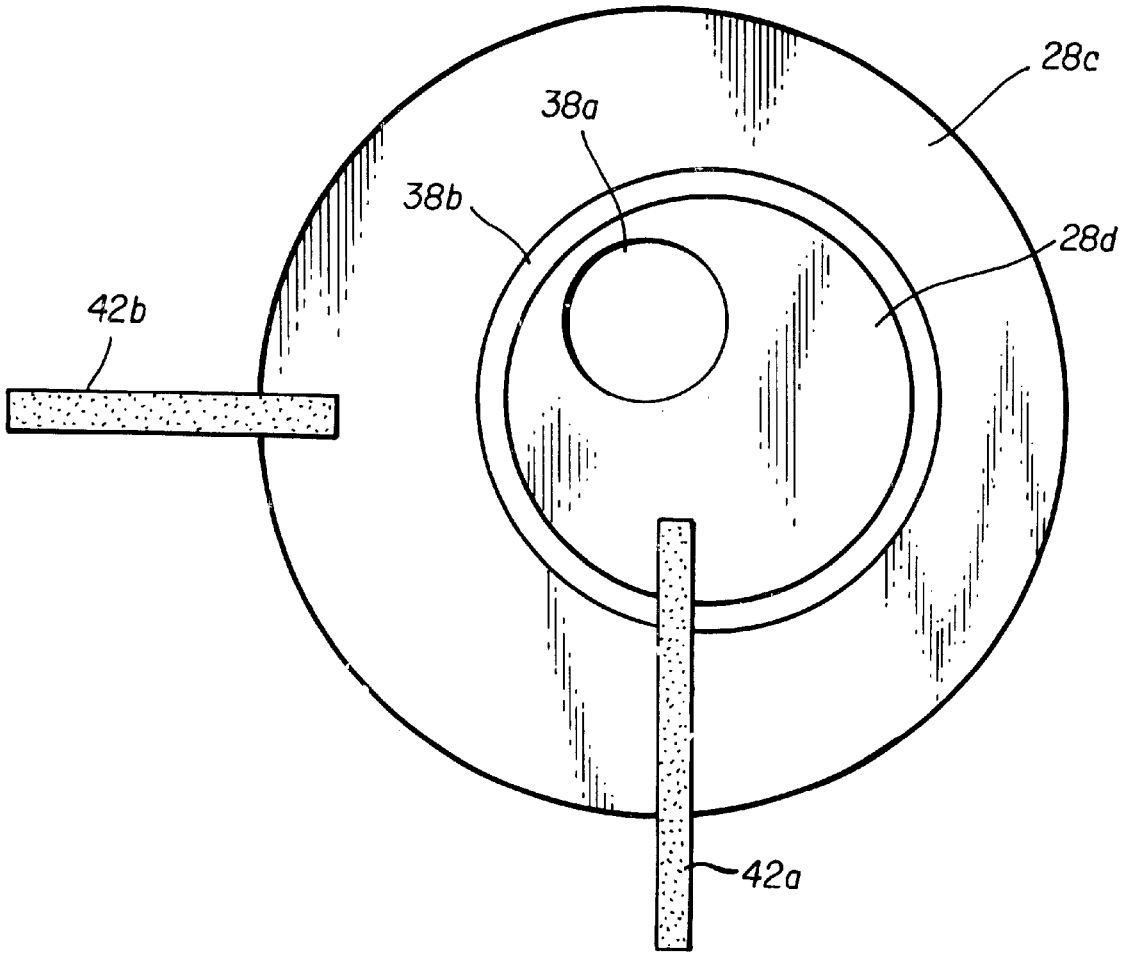
FIG. 2*e* shows two disks, one positioned inside the other, the inner disk positioned over the nozzle opening, in accordance with one embodiment of the present invention.

The amount of offset of off-center aperture 38 from the center axis of disk 28 is determined by the manufacturing process of off-center aperture 38; and therefore, although the direction of the angle of deflection caused by off-center aperture 38 can be controlled by rotating the aperture, the magnitude of the correction, being proportional to the offset, is determined at the time of manufacture. If it is desired to control the magnitude of correction as well, disk 28 with off-center aperture 38 can be replaced by two disks, an inner disk 28*d* and an outer disk 28*c,* shown in FIG. 2*e,* each having an off-center aperture, inner off-center aperture 38*a* and outer off-center aperture 38*b,* the outer edge of the inner disk 28*d* fitting inside the off-center aperture 38*b* of the outer disk 28*c.* By rotating one disk with respect to the other, for example, by employing two thermal actuators, inner thermal actuator 38*a* and outer thermal actuator 38*b,* each similar to thermal actuator 42 but configured to rotate the inner and outer disks 28*d* and 28*c,* respectively, the amount of offset of the aperture of inner disk 28*d* from the center axis of outer disk 28*c* can be controlled, as well as the angle of the offset of the opening of the inner disk 28*d* from the axis of nozzle opening 26, as can be appreciated by one skilled in the art of mechanical engineering. In this embodiment, a greater degree of compensation can be achieved for nozzles whose ejected ink drops are misdirected.

Figure 3:
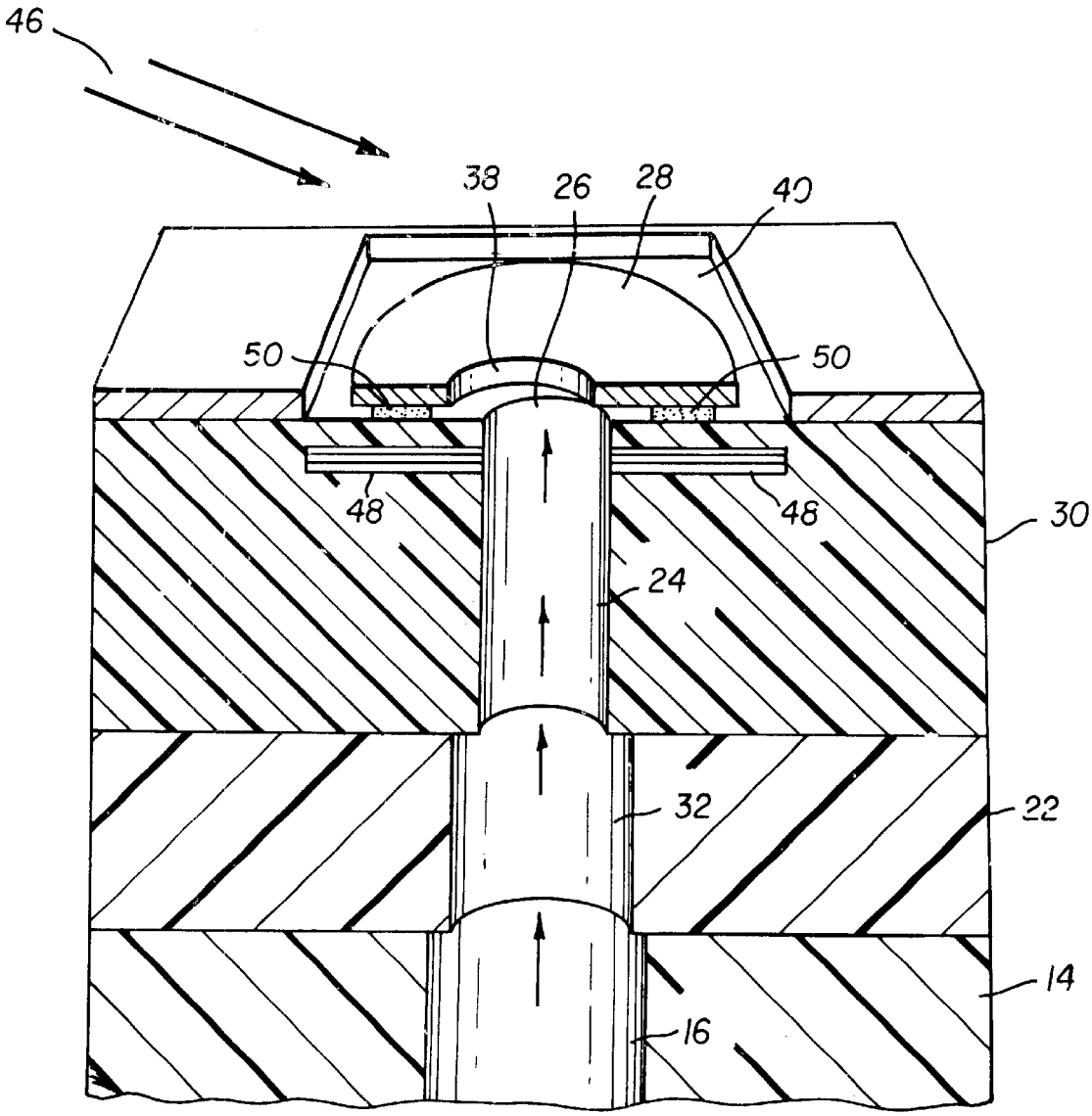
FIG. 3 depicts a cross-section of an inkjet printhead nozzle and disk retained by wax, which is activated by an internal heater and adjusted by an externally applied force, in accordance with one embodiment of the present invention.

Similarly, in FIG. 3, a disk 28 having an off-center disk aperture 38 is positioned over the nozzle opening 26 in a recessed region 40 of membrane 30. In this case, however, an adhesive 50, such as wax or glue, rather than a finger-like actuator 42, retains the disk 28. Once the nozzle 24 has been tested and identified as needing compensation, an internal heater 48 is activated by passage of an electrical current. Thus, the internal heater 48, when activated, is configured to transition the wax 50 into its molten state in order to release the disk 28. An external force 46 is then applied to adjust the position of the disk 28. Once the disk 28 has been adjusted so as to cause ink 34 ejected from the nozzle opening 26 to be deflected with regard to the desired amount of compensation, the internal heater 48 is deactivated. As a result, the wax 50 is cooled and the disk 28 is secured in its desired position. The external force 46 may, for example, be applied by physical contact with a stylus whose position can be adjusted using a piezoelectric transducer, as is well known in the art of precision motion control.

In this case, the disk 28 can slide over the nozzle 24 so that the off-center disk aperture 38 traverses the nozzle opening 26, in addition to being rotated, provided that the recessed region 40 is larger in length and width than the diameter of disk 28, as shown in FIG. 3. Therefore, the disk aperture 38 need not be off-center of disk 28, but also can be centered on the disk 28 and yet still compensate for the effects of defects in the inkjet printhead 10 to alter the direction of ink drops 37 ejected from the nozzle 24.

Figure 4:
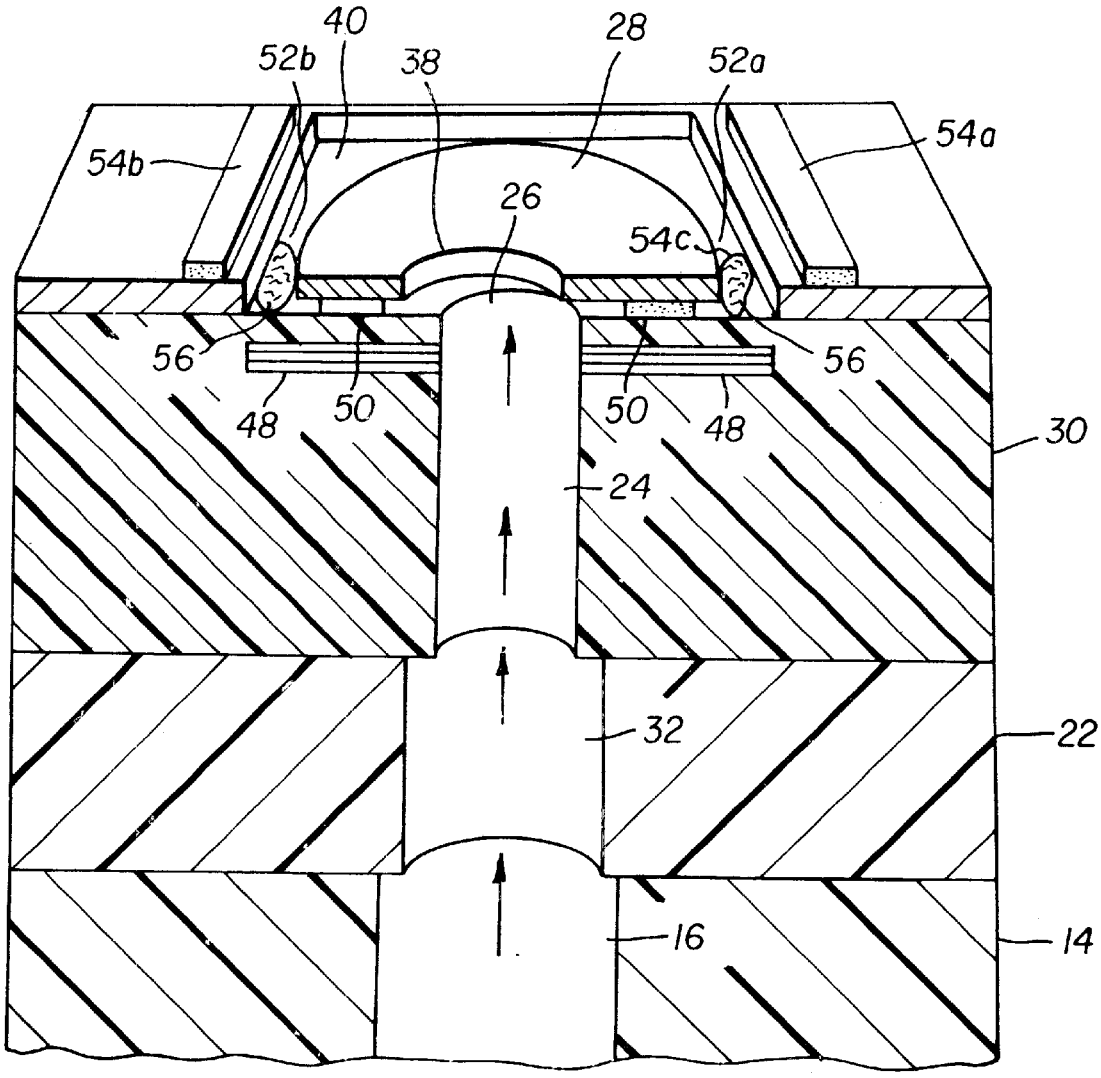
FIG. 4 shows a cross-sectional view of an inkjet printhead nozzle and disk, retained by wax and adjusted by thermally expandable material via external heaters, in accordance with one embodiment of the present invention.

With reference to FIG. 4, a cross-sectional view of inkjet printhead 10 and disk 28 illustrates another embodiment, similar to FIG. 3, of the present invention. Alternatively, once the internal heater 48 has caused the wax 50 to melt and the disk 28 to be released, an adjustment force replaces the external force 46 shown in FIG. 3. The adjustment force is generated by one or more thermally expandable beads 54*c,* which comprise a plastic material and require the application of heat.

In operation, at least one external heater 54*a,* 54*b* is activated. The external heaters 54*a,* 54*b* are adapted to expand the mass of thermally expandable material 56 with regard to the desired amount of compensation. For example, if the disk 28 requires adjustment from left to right, then the left external heater 54*b* is activated and the right external heater 54*a* remains deactivated. As such, the application of heat to the thermally expandable bead 56 on the left, as shown in FIG. 4, results in a compressed side 52*a,* where the edge of disk 28 has moved closer to the edge of recessed region 40 and an expanded side 52*b,* where the edge of disk 28 has moved farther from the edge of recessed region 40.

Once the disk 28 has been adjusted so as to cause ink 34 ejected from the nozzle opening 26 to be deflected with regard to the desired amount of compensation, the internal heater 48 is deactivated. This allows the wax 50 to cool and the disk 28 to be secured in its desired position. The external heater 54*b* is then deactivated in order to cease expansion of the thermally expandable bead 56, as illustrated in FIG. 4. Although FIG. 4 shows two beads 56 of expandable material at two positions around disk 28 and two external heaters 54*a,* 54*b* on membrane 30 neat the beads 56, other preferred embodiments may comprise more than two thermally expandable beads 56, each with an external heater nearby to allow adjustments in the position of disk 28 when wax 50 has been melted. In this case, heat may be applied to more than one of the external heaters.

In yet another preferred embodiment, thermally expandable material 56 occupies the entire recessed region 40 between the outer edge of disk 28 and the edges of recessed region 40, and more than two external heaters are positioned on membrane 30 around the edges of recessed region 40.

In yet another related preferred embodiment, thermally expandable material 56 occupies the entire recessed region 40, which is circular in shape, between the outer edge of disk 28 and the edges of recessed region 40. In all these cases, the external heaters, such as external heaters 54*a,* 54*b,* may be made from a thin film of resistive material, such as titanium nitride, through which a current may be passed from electrical circuits on substrate 22, or from external current sources, as is well known to one skilled in the art of thin film fabrication or silicon processing.

Figure 5:
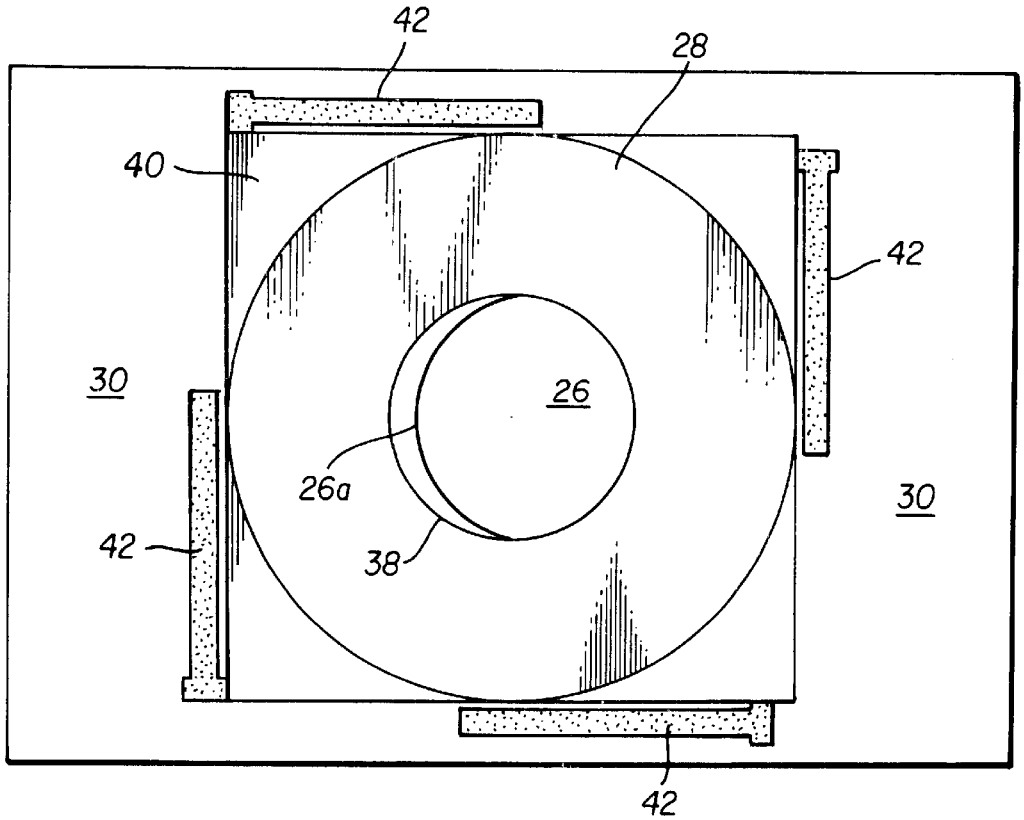
FIG. 5 illustrates a top view of a nozzle and disk adjusted by multiple thermal actuators over the nozzle opening, in accordance with one embodiment of the present invention.

FIG. 5 illustrates another embodiment of the present invention in which thermal actuators 42, also referred to as bi-metallic strip actuators, known in the art of microsystems technology, are disposed around the disk 28 so as to control its position from multiple sides. As previously discussed, the disk 28 may be retained and released for adjustment via sliding by an underlying layer of wax 50 as in the case of FIGS. 3 and 4. Alternatively, one or more thermal actuators 42 can also be used to retain and release the disk 28. With regard to the desired amount of compensation, the disk 28 can be adjusted from any side by applying heat to one or more finger-like actuators 42. Such application of heat causes the actuators to exert a lateral force on the disk 28.

The finger-like actuators 42 can be of the shape memory alloy type, which deform semi-permanently when heated over a first temperature range and return to their original shape when heated to a second, higher, temperature range. In this case, the actuators 42, when not in their actuated state, serve to hold the disk 28 forcibly down in the recessed region 40 of the membrane 30.

While this invention has been described with reference to illustrative embodiments, this description is not intended to be construed in a limiting sense. Various modifications and combinations of the illustrative embodiments, as well as other embodiments of the invention, will be apparent to persons skilled in the art upon reference to the description. It is, therefore, intended that the appended claims encompass any such modifications or embodiments.

PARTS LIST

10 . . . inkjet printhead
12 . . . mounting block
14 . . . gasket manifold
16 . . . inlet/outlet tubes
18 . . . fluid-flow channels
20 . . . ink reservoir
22 . . . substrate
24 . . . nozzle or nozzles
26 . . . nozzle opening or orifice
26*a* . . . nozzle opening edge
28 . . . disk
28*a* . . . protruding disk edge
28*b* . . . receding disk edge
28*c* . . . outer disk
28*d* . . . inner disk
30 . . . membrane
32 . . . nozzle cavity
34 . . . ink
36 . . . ink stream
37 . . . ink drops
38 . . . off-center aperture, or disk aperture
38*a* . . . inner off-center aperture
38*b* . . . outer off-center aperture
40 . . . recess region
42 . . . thermal actuator, or finger-like actuator
42*a* . . . inner thermal actuator
42*b* . . . outer thermal actuator
44 . . . rotated direction
46 . . . external force
48 . . . internal heater
50 . . . wax, adhesive, or glue
52*a* . . . compressed side
52*b* . . . expanded side
54*a* . . . right external heater
54*b* . . . left external heater
56 . . . thermally expandable material or beads

What is claimed is:

1. An inkjet printhead with integral compensation for misdirection of ink drops ejected through at least one nozzle of the printhead comprising:

a substrate forming a wall which defines a nozzle cavity adapted for facilitating the flow of ink from an ink reservoir;

a membrane predisposed about said nozzle cavity to create a resistive barrier against ink flow, said membrane including a nozzle opening through which ink drops are ejected;

a first disk positioned over said nozzle opening, said first disk having an aperture about its axis; and one or more actuators configured to move said first disk so that said aperture is controllably offset from said nozzle opening;

wherein said first disk is adapted to cause ink ejected from said nozzle opening via said aperture to be deflected with regard to a desired amount of compensation when said aperture is offset from said nozzle opening.

2. The inkjet printhead according to claim 1 further comprising a second disk having an off-center aperture, said second disk placed inside said first disk, said first and second disks positioned over said nozzle opening.

3. The inkjet printhead according to claim 2 further comprising a second actuator configured to independently rotate said second disk.

4. The inkjet printhead according to claim 1 wherein said membrane further comprises a recess configured to accept said first disk.

5. The inkjet printhead according to claim 4 wherein said first disk is configured to rotate in any direction within said recess.

6. The inkjet printhead according to claim 1 wherein said first disk comprises a solid material.

7. The inkjet printhead according to claim 1 further comprising an adhesive layer underlying said first disk, said adhesive adapted to melt allowing said first disk to slide.

8. The inkjet printhead according to claim 1 wherein said aperture is centered with respect to said first disk.

9. The inkjet printhead according to claim 1 wherein the size of said aperture of said first disk is the same as that of said nozzle opening.

10. The inkjet printhead according to claim 1 wherein the aperture is off-center from the axis of said first disk.

11. The inkjet printhead according to claim 10 wherein said printhead further comprises a means for rotating said first disk over said nozzle so that said off-center aperture rotates about said nozzle opening.

12. The inkjet printhead according to claim 10 wherein said printhead further comprises a means for sliding said first disk over said nozzle in all directions so that said off-center aperture can entirely traverse said nozzle opening in all directions.

13. The inkjet printhead according to claim 1 wherein said actuators are coupled to said membrane.

14. The inkjet printhead according to claim 1 wherein said actuators are shaped memory alloy type.

15. The inkjet printhead according to claim 1 wherein said actuators are of the bi-metallic type.

16. The inkjet printhead according to claim 1 wherein said actuators are of the piezo type.

17. The inkjet printhead according to claim 1 wherein said printhead further comprises a means for determining the amount of compensation desired in the direction of ink ejected from said nozzle opening.

18. For an inkjet printhead having at least one nozzle and a nozzle opening in said nozzle, a disk positioned over said nozzle opening, said disk having an off-center aperture about the disk axis, a method of compensating for the effects of defects in the printhead to alter the direction of ink drops ejected from the nozzle comprising the steps of:

determining the amount of compensation desired in the direction of ink ejected from said nozzle opening; and sliding said disk over said nozzle so that said off-center aperture traverses said nozzle opening and causes ink ejected from said nozzle opening to be deflected with regard to the desired amount of compensation.

19. The method according to claim 18 wherein said determining step is preceded by the step of testing said inkjet printhead to determine the ink stream directionality onto a receiver medium from a nozzle opening.

20. The method according to claim 19 wherein said testing step is followed by the step of identifying variability in the direction of the ink drops ejected from a nozzle of said inkjet printhead caused by manufacturing defects.

21. The method according to claim 18 wherein said sliding step further includes the step of applying heat to at least one finger-like actuator, said heat causing said finger-like actuator to traverse in an up and down direction about said disk.

22. The method according to claim 21 wherein said step of applying heat is followed by the step of ceasing the application of heat to said finger-like actuator causing to hold said disk in the desired position.

23. The method according to claim 18 wherein said sliding step is preceded by the step of activating at least one internal heater, said heater adapted to melt the adhesive and release said disk.

24. The method according to claim 23 wherein said activating step is followed by the step of applying an external force to said disk.

25. The method according to claim 24 wherein said step of applying an external force further comprises the step of deactivating said internal heater in order to allow said adhesive to cool.

26. The method according to claim 23 wherein said activating step further includes the step of activating at least one external heater, said heater adapted to expand a mass of thermally expandable material.

27. The method according to claim 26 wherein said step of activating at least one external heater is followed by the step of deactivating said internal heater in order to allow said adhesive to cool.

28. The method according to claim 27 wherein said step of deactivating said internal heater further comprises the step of deactivating said external heater in order to cease expansion of said thermally expandable material.

29. An inkjet printhead with integral compensation for misdirection of ink drops ejected through at least one nozzle of the printhead comprising:

a substrate forming a wall which defines a nozzle cavity adapted for facilitating the flow of ink from an ink reservoir;

a membrane predisposed about said nozzle cavity to create a resistive barrier against ink flow, said membrane having a recessed region including a nozzle opening through which ink drops are ejected;

a disk positioned over said nozzle opening, said disk having an off-center aperture about its axis;

an adhesive adapted to secure said disk to said membrane;

one or more internal heaters integrated within said membrane, said heaters configured to transition said adhesive into a molten state; and a force applied to said disk in order to adjust its position;

wherein said adhesive when melted is adapted to release said disk and allow for said force to be effectively applied.

30. The inkjet printhead according to claim 29 wherein said recessed region is symmetrical with said nozzle opening and is configured to accept said disk.

31. The inkjet printhead according to claim 29 wherein said disk is configured to rotate in any direction within said recessed region.

32. The inkjet printhead according to claim 29 wherein the size of said off-center aperture of said disk is the same as that of said nozzle opening.

33. The inkjet printhead according to claim 29 wherein said disk comprises a solid material.

34. The inkjet printhead according to claim 29 wherein said internal heaters are further configured to activate via passage of an electrical current.

35. The inkjet printhead according to claim 29 wherein said force includes an external force or an adjustment force.

36. The inkjet printhead according to claim 35 wherein said adjustment force is generated by one or more thermally expandable beads, said beads comprising a plastic material.

37. The inkjet printhead according to claim 36 wherein said expandable material entirely fills the recessed region outside an edge of said disk.

38. The inkjet printhead according to claim 29 further comprising a right adjustment heater and a left adjustment heater, said heaters predisposed about said nozzle opening.

39. The inkjet printhead according to claim 38 wherein said beads are adapted to expand and contract when heated by said adjustment heaters.

40. The inkjet printhead according to claim 38 wherein said adjustment heaters are positioned about said recessed region in order to control the degree of expansion of the thermally expandable beads at multiple places around the disk.

41. The inkjet printhead according to claim 29 further comprising a means for determining the amount of compensation desired in the direction of ink ejected from said nozzle opening.

42. The inkjet printhead according to claim 29 further comprising a means for sliding said disk over said nozzle so that said off-center aperture traverses said nozzle opening.

43. A method of operating an inkjet printhead having a plurality of nozzles, each nozzle having a nozzle opening associated with said nozzle, a disk having an aperture positioned over each said opening, a disk aperture geometry relative to a respective nozzle opening associated with at least one nozzle being different than that associated with other nozzles so as to correct the direction of ink drops ejected from the nozzle, the method comprising the steps of:

ejecting ink drops from each of plural nozzles; and ejecting ink drops from the at least one nozzle so that ink drops ejected from the nozzle are ejected generally parallel with ink drops ejected from the each of the plural nozzles because of correction of drop ejection by the disk aperture associated with the at least one nozzle.

44. An inkjet printhead having a plurality of nozzles, each nozzle having a nozzle opening associated with said nozzle, a disk having an aperture positioned over each said opening, a disk aperture geometry relative to a respective nozzle opening associated with at least one nozzle being different than that associated with other nozzles so as to correct the direction of ink drops ejected from the at least one nozzle.

* * * * *